United States Patent [19]

Lecinski, Jr.

[11] Patent Number: 4,576,299

[45] Date of Patent: Mar. 18, 1986

[54] CLOSURE CAP WITH IMPROVED TOP-LOAD LEAKAGE RESISTANCE

[75] Inventor: Frank H. Lecinski, Jr., Harwood Heights, Ill.

[73] Assignee: Continental White Cap, Inc., Northbrook, Ill.

[21] Appl. No.: 665,887

[22] Filed: Oct. 29, 1984

[51] Int. Cl.[4] ..... B65D 41/22

[52] U.S. Cl. ..... 215/318

[58] Field of Search ..... 215/318, 346, 341, 343, 215/345

[56] References Cited

U.S. PATENT DOCUMENTS 3,371,813 3/1968 Owen et al. ..... 215/318

3,448,881 6/1969 Zipper ..... 215/318

*Primary Examiner*—Donald F. Norton

*Attorney, Agent, or Firm*—Charles E. Brown

[57] ABSTRACT

A closure cap of the press-on type wherein the sealant or gasket is flowable both to interlock the closure cap with threads on the container and to form a seal with the end surface of the container. The configuration of a radially inner part of an annular portion of the sealant has been changed to increase the thickness thereof whereby, when the closure cap is applied, a normal seal is formed with the container end sealing surface and a further seal of the piston-cylinder type is formed between the sealant and the radially inner cylindrical surface of the container. This secondary seal permits an overloading of the closure cap relative to the container due to stacking, but maintains the seal between the closure cap and the container even though the sealant may temporarily move away from the end sealing surface of the container.

5 Claims, 8 Drawing Figures

CLOSURE CAP WITH IMPROVED TOP-LOAD LEAKAGE RESISTANCE

This abstract is not to be construed as limiting the claims of the application.

This invention relates in general to new and useful improvements in closures for containers, and more particularly to a closure cap having therein a sealant or gasket which engages an end sealing surface of a container to effect an airtight seal between the closure cap and the container.

In existing closures there is frequently a release of the seal between the sealant or gasket material and the container sealing surface due to an overloading of the sealant and a resultant deformation thereof. Containers are packaged in units and the units are then palletized. The packaging may be in boxes or may be by way of a plastic wrap material. The pallets are then stacked three or four high. Further, certain pallets may have a knot or like projection on which a container seats slightly above the level of other containers in the packaged unit. The net result is that frequently the closure cap is pressed down on the container under a loading greater than that at which the closure cap was applied and the sealant or gasket becomes unduly compressed.

When the packaged containers are unloaded, the overloading pressure is suddenly released and the seal between the sealant or gasket and the end sealing surface of the container is broken. While the sealant may reform and again contact the sealing surface, the internal pressure or vacuum within the container is lost.

This invention relates to a modification of the configuration of the sealant or gasket whereby that portion of the sealant or gasket aligned with the radially inner surface of the container extends down into the container. Since the radially inner surface of the container is in the form of a cylinder, that portion of the sealant which extends into the container tightly engages the cylindrical surface and functions as a piston.

With the modified form of sealant or gasket, when the closure cap is overloaded and the sealant is deformed, the sealant retains its piston-cylinder relationship, and when the load is suddenly released, while the sealant or gasket may move away from the end sealing surface of the container as before, the piston-cylinder relationship continues to exist and prevents a complete separation of the sealant from the container. The piston-cylinder relationship maintains the seal until the sealant may reflow or reform again to contact the end sealing surface of the container in sealed relation.

With the above and other objects in view that will hereinafter appear, the nature of the invention will be more clearly understood by reference to the following detailed description, the appended claims, and the several views illustrated in the accompanying drawings.

Figure 1:
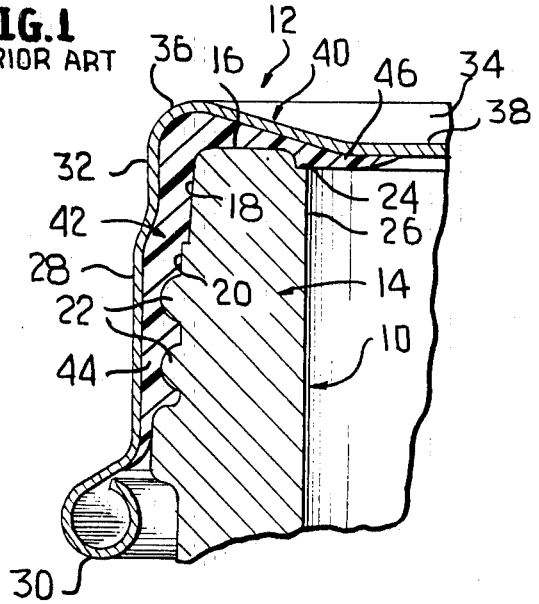
FIG.1 PRIOR ART
FIG. 1 is a fragmentary vertical sectional view taken through the upper part of a container, and shows the relationship between the neck finish of the container and a closure cap of a conventional type.
Figure 2:
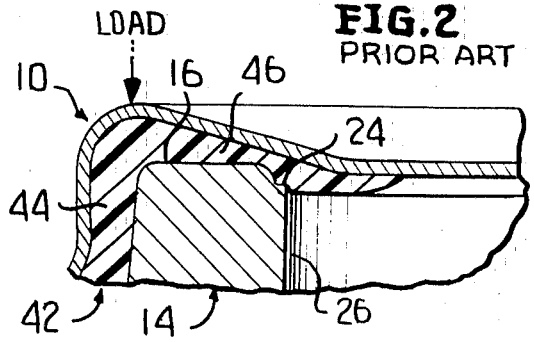
FIG.2 PRIOR ART
FIG. 2 is a fragmentary vertical sectional view similar to FIG. 1, and shows the closure cap unduly loaded as would occur in stacking with the resultant compressing and flowing out of the sealant.
Figure 3:
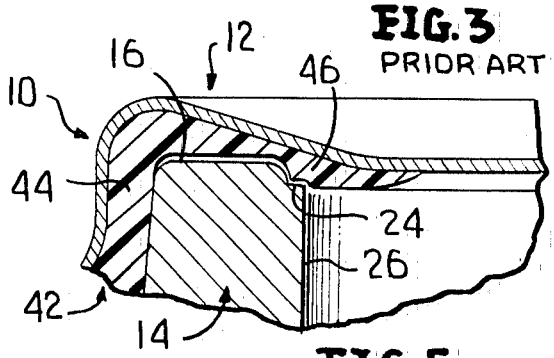
FIG.3 PRIOR ART
FIG. 3 is a fragmentary vertical sectional view similar to FIG. 2, but shows the load having been just relieved from the closure cap and the seal between the closure cap and the container broken as occurs with existing closure caps.

Reference is now made to FIGS. 1, 2 and 3 wherein there is illustrated a conventional container 10 which is closed by a conventional closure cap 12. The container 10 is provided with a neck finish generally identified by the numeral 14, which neck finish is provided with a sealing surface 16. Externally the neck finish 14 is generally cylindrical as at 18, and therebelow is provided with a thread portion 20 having threads 22 projecting therefrom.

Radially inwardly of the sealing surface 16, the end of the neck finish 14 is stepped to define a narrow ledge or shoulder 24. The shoulder 24 terminates at its radially inner edge in a radially inner cylindrical surface 26.

The closure cap 12 is generally in the form of a cup-shaped member and includes a skirt 28 terminating at its lower edge in a radially inwardly turned curl 30. The upper portion of the skirt 28 is radially inwardly offset to form an offset portion 32. The offset portion 32 is connected to an end panel 34 by a radius 36. In a preferred embodiment, the end panel 34 has a centrally recessed portion 38 and a radially outer axially upwardly and radially outwardly sloping portion 40.

Figure 4:
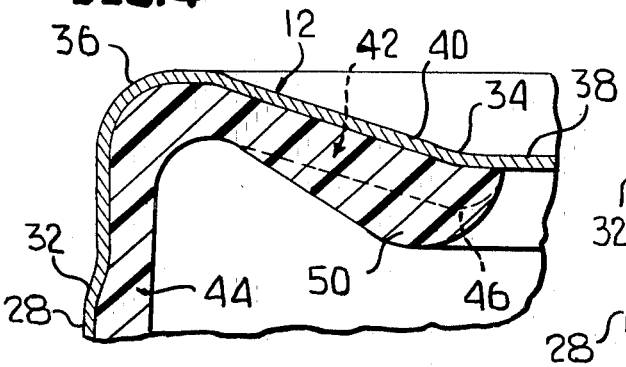
FIG. 4 is a schematic sectional view through the closure cap, and shows the configuration of one embodiment of the sealant with respect to the original sealant.
Figure 5:
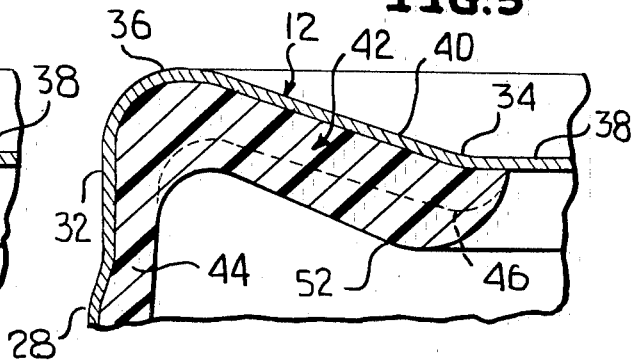
FIG. 5 is a view similar to FIG. 4, and shows a modified sealing arrangement in comparison to the original sealant.

The closure cap 12 also includes a sealant or gasket generally identified by the numeral 42 which is generally of an inverted L-shaped configuration. The sealant 42 includes a generally cylindrical vertical portion 44 which lies adjacent the skirt 28. The sealant 42 also includes an annular portion 46 which underlies the outer portion of the end panel 34. The general configuration of the sealant 42 before application is best shown in FIGS. 4 and 5.

It is to be understood that the sealant 42 is flowable under pressure and the closure cap 12 is applied to the container by pressing the same onto the container with the sealant 42 flowing around the threads 22 and around the end of the neck finish 14.

In the past, the thickness of the annular portion 46 of the sealant has been such that when the closure cap is fully applied the underside of the sealant just engages or is axially spaced from the shoulder 24. No part of the sealant engages the cylindrical radially inner surface 26 of the container.

When the sealed containers 10 are stacked in the manner described above, an undue load may be placed on one of the closure caps 12, and more particularly on the annular portion 46 of the sealant 42, with the result that the closure cap moves downwardly on the container a limited amount as is shown in FIG. 2. This does not disturb the seal.

However, when the load is removed from the sealant, the sealant does not immediately reflow to conform to the shape of the neck finish 14 with the result that the seal between the sealant 42 and the end sealing surface 16 is broken. Although this seal will eventually be reformed as the sealant reflows to contact the end sealing surface 16, the damage is done.

In accordance with this invention it is proposed to modify the configuration of the sealant 42, and more particularly the configuration of the annular portion 46 of the sealant. Two embodiments of the modified sealant configuration are shown in FIGS. 4 and 5.

With particular reference to FIG. 4, it will be seen that the generally cylindrical portion 44 of the sealant remains unchanged. However, the radially inner part of the annular portion 46 is modified so as to increase the thickness radially inwardly and thus provide a radially inner part 50 of an increased thickness as compared to a like part of the annular portion 46 of the original sealant 42.

In the embodiment of FIG. 4, the radially inner part of the annular portion remains relatively thin. However, in accordance with the embodiment of FIG. 5, the sealant annular portion is of a generally constant thickness which is materially greater than that of the original annular portion 46. This modified annular portion is identified by the numeral 52.

Figure 6:
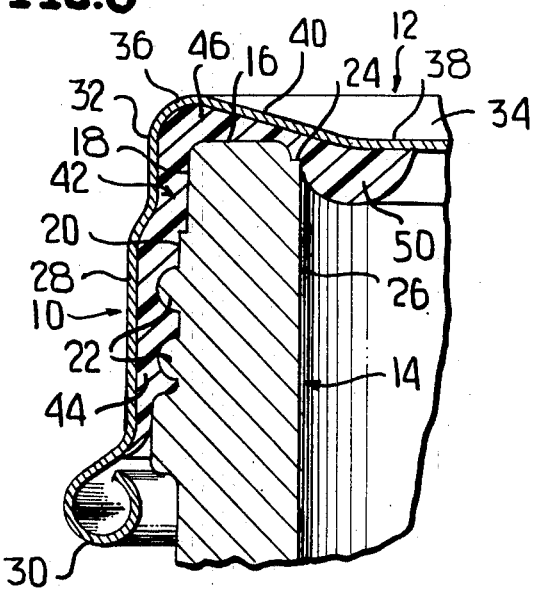
FIG. 6 is an enlarged fragmentary vertical sectional view similar to FIG. 1, and shows the relationship of the sealant formed in accordance with this invention with respect to the container neck finish.

Reference is now made to FIG. 6 wherein the modified sealant of FIG. 4 is engaged with the container 10 in the normal manner. It will be seen that the sealant not only forms a seal with the end sealing surface 16, but also the radially inner part 50 of the annular portion 46 extends down into the mouth of the container 10 and engages in sealing relation the radially inner cylindrical surface 26. It will be seen that a piston-cylinder relationship exists.

Referring to FIG. 1, it will be seen that the sealant radially inwardly of the end sealing surface 16 extends downwardly a distance on the order of 0.015 inch which generally corresponds to the axial offset of the shoulder 24 with respect to the end sealing surface 16. On the other hand, as is shown in FIG. 6, the modified radially inner part 50 extends down below the end sealing surface 16 a distance ranging from 0.025 to 0.045 inch, with the result that the piston defined by the radially inner part 50 of the sealant has an effective height ranging from 0.010 to 0.030 inch. This has been found to be adequate to maintain the piston-cylinder relationship under all overload conditions.

Figure 7:
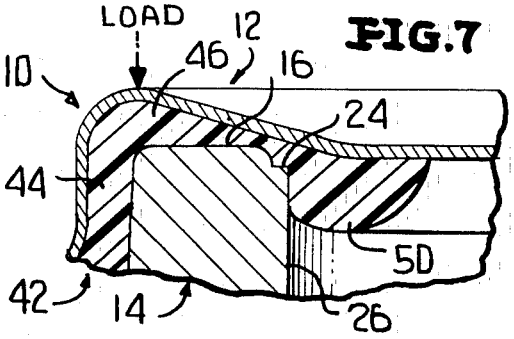
FIG. 7 is a fragmentary vertical sectional view similar to FIG. 6, and shows the closure cap of FIG. 6 with an overloading thereon and the resultant compressing and flowing of the sealant.

Referring now to FIG. 7, it will be seen that the closure cap 12 with the modified sealant is loaded in the same manner as is the closure cap shown in FIG. 1. The reforming of the sealant 42 does not destroy the piston-cylinder relationship between the sealant and the radially inner cylindrical surface of the container.

Figure 8:
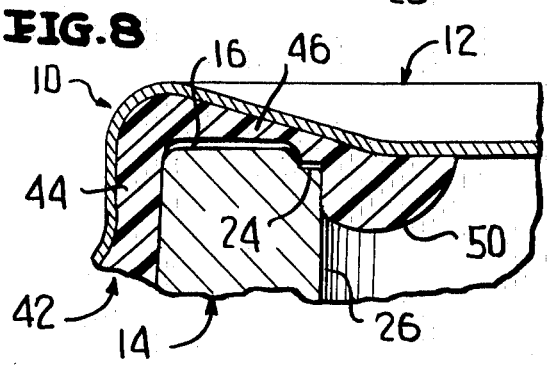
FIG. 8 is a fragmentary vertical sectional view similar to FIG. 7, and shows the closure cap immediately after the load thereon has been relieved with the sealant being spaced from the container end sealing surface, but with the seal being maintained by the piston-cylinder relationship of the sealant and the cylindrical radially inner surface of the container.

Referring now to FIG. 8, it will be seen that when the overload is released from the closure cap initially the sealant moves away from the end sealing surface while the piston-cylinder sealing relationship remains. Thus there is no interruption of the seal between the sealant and the container when the configuration of the sealant is slightly modified as illustrated in FIG. 4.

No attempt has been made specifically to illustrate the function of the modified configuration of the sealant shown in FIG. 5. It is to be understood, however, that for all practical purposes it will be initially the same as that shown in FIGS. 6–8.

Although only two preferred embodiments of the modified sealant configuration have been specifically illustrated and described, it is to be understood that minor variations may be made in the sealant configuration without departing from the spirit and scope of the invention as defined by the appended claims.

I claim:

1. A closure cap of the press on/twist off type wherein there is a shell including a skirt and an end panel, and within said shell there is a sealant of a generally inverted L-shape cross section including a generally cylindrical portion adjacent said skirt and an annular portion adjacent said end panel, said annular sealant portion being specifically adapted to engage in sealing relation an end sealing surface of a container in sealed relation, said closure cap being improved by at least that part of said annular sealant portion remote from said skirt being of an increased thickness with the thickness of said part of said annular sealant portion remote from said skirt being sufficient to form a seal with an internal cylindrical surface of a container finish, the thickness of said part of said annular sealant portion being such as to have a container neck finish engaging depth ranging from 0.025 to 0.045 inch as compared to a depth on the order of 0.015 inch for existing closure caps of the same size and shape.

2. A closure cap according to claim 1 wherein the thickness of said annular sealant portion gradually decreases radially outwardly.

3. A closure cap according to claim 1 wherein said annular sealant portion when engaged with a container finish provides a piston-cylinder relationship with the container internal cylindrical surface.

4. A closure cap according to claim 1 wherein the thickness of said annular sealant portion is generally constant.

5. A closure cap and container neck finish combination comprising a container having a neck finish including an end sealing surface and a radially inner cylindrical surface axially spaced from said end sealing surface; and a closure cap including a shell having therein a sealant of a generally inverted L-shaped cross section, said shell including a skirt and an end panel, said sealant having a generally cylindrical portion disposed adjacent said skirt and telescoped over said container neck finish, said sealant also having an annular portion overlying and deformably engaged with said end sealing surface: said combination being improved by said annular sealant being of a thickness to extend axially into said container in sealing engagement with said container radially inner cylindrical surface with there being a piston-cylinder relationship between said sealant and said container radially inner cylindrical surface whereby when said sealant annular portion is unduly over deformed due to overloading and suddenly released, said piston-cylinder relationship maintains the seal between said closure cap and said container until said sealant inherently deforms to effect the original seal, the axial extent of said sealant along said container radially inner cylindrical surface ranging from 0.010 to 0.030 inch.

* * * * *